United States Patent [19]

Caldwell

[11] 4,183,345

[45] Jan. 15, 1980

[54] ARCHER'S BOW WITH INTERMEDIATELY PIVOTED LIMBS

[76] Inventor: Joseph M. Caldwell, 2259 W. Big Tujunga Canyon, Tujunga, Calif. 91042

[21] Appl. No.: 820,636

[22] Filed: Aug. 1, 1977

[51] Int. Cl.[2] ..... F41B 5/00

[52] U.S. Cl. ..... 124/24 R; 124/90; 29/235

[58] Field of Search ..... 124/23 R, 24 R, 22, 124/25, 35 A, 41 A, 86, 88, 80; 29/235

[56] References Cited

U.S. PATENT DOCUMENTS

| | | | |
|---|---|---|---|
| 477,747 | 6/1892 | Emerson | 124/8 |
| 586,713 | 7/1897 | Peters | 124/24 R |
| 785,050 | 3/1905 | Saunders | 124/25 |
| 1,932,195 | 10/1933 | Stroup | 124/23 X |
| 3,028,851 | 4/1962 | Drake | 124/16 |
| 3,486,495 | 12/1969 | Allen | 124/24 R |
| 3,674,001 | 7/1972 | Hitt | 124/24 R |
| 3,812,835 | 5/1974 | Smith | 124/24 R |
| 3,967,609 | 7/1976 | Frydenlund | 124/24 R |
| 3,981,290 | 9/1976 | Islas | 124/24 R |
| 4,018,205 | 4/1977 | Meyer | 124/24 R |
| 4,076,005 | 2/1978 | Hill | 124/24 R |

OTHER PUBLICATIONS

"Martin's M-10 Cheetah Dynabo"—Bow and Arrow Magazine p. 6, Aug. 1977.

Pages 2 & 3, 4 & 5—1976 Archery Catalogue Precision Shooting Equipment, Inc.

Pages 10 & 11—1977 Catalogue of Jennings Compound Bow, Inc.

*Primary Examiner*—Richard C. Pinkham
*Assistant Examiner*—William R. Browne
*Attorney, Agent, or Firm*—Christie, Parker & Hale

[57] ABSTRACT

An archer'shooting bow comprises a pair of elongate resilient limbs, each disposed at a respective end of an elongate rigid handle riser assembly which has a central handle portion. The limbs have outer tips at the opposite ends of the bow. A bowstring is coupled between the outer limb tips adjacent the rear face of the handle riser assembly. The bowstring has a nocking point adapted to be drawn from a rest position to a drawn limb-flexing position on application of drawing force thereto. A mounting device connects each limb only at a location intermediate its length to the respective end of the handle riser assembly for hinging motion of the limb relative to the assembly about an axis disposed substantially perpendicular to the plane in which the bowstring moves in being drawn from its rest to its drawn position. The geometries of the mountings of the limbs to the assembly are such that each limb has an inner tip adjacent a front face of the handle riser assembly proximate the handle portion. A tether device is connected between each limb inner tip and the handle riser assembly for constraining the inner tip from movement away from the assembly in response to application of drawing force to the bowstring. As the bow is drawn, each limb flexes on both sides of its point of hinging connection to the handle riser assembly in a manner analogous to a simply supported beam loaded by a concentrated load at said location. A bow having only one such limb and tether arrangement is also described.

39 Claims, 18 Drawing Figures

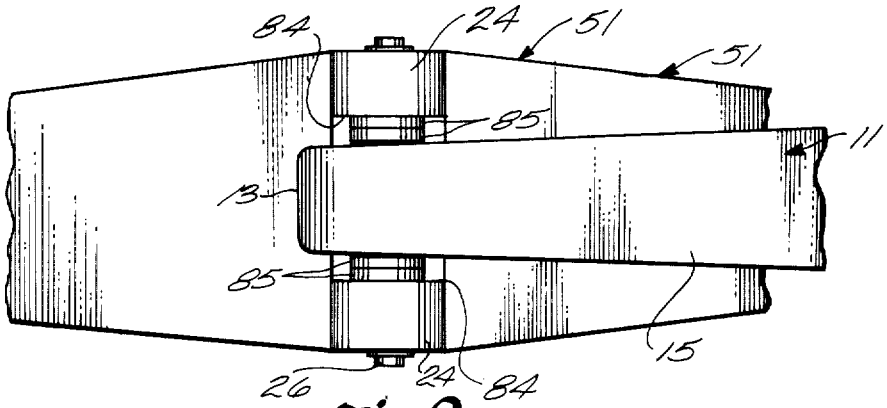
Fig. 9
Fig. 18
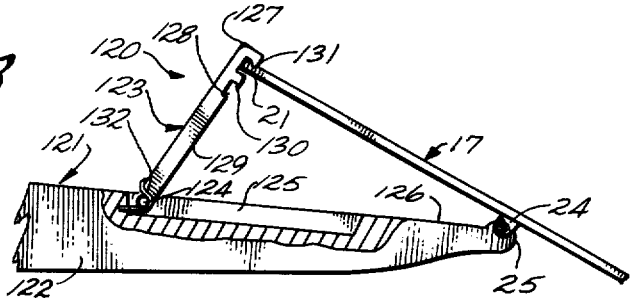
Fig. 12
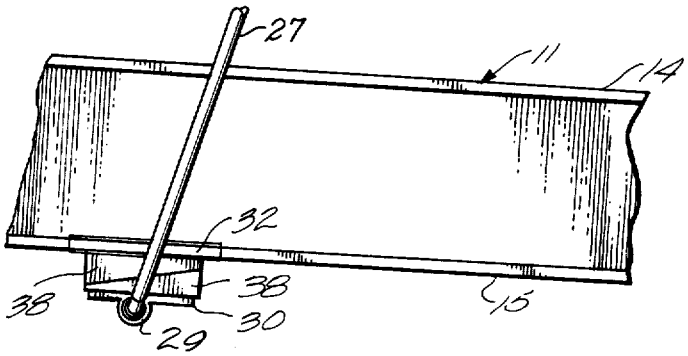
Fig. 10
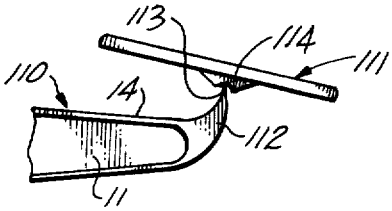

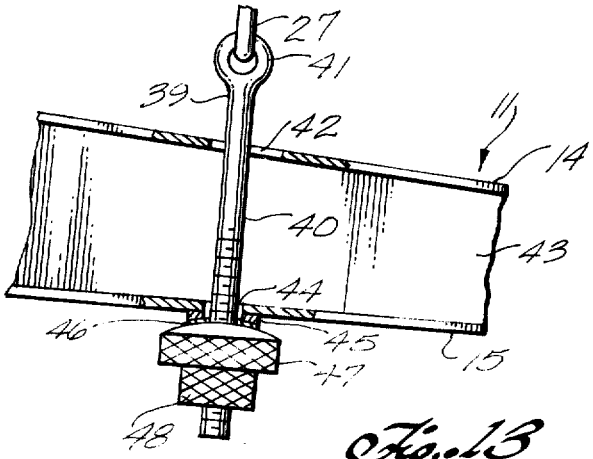
Fig. 13
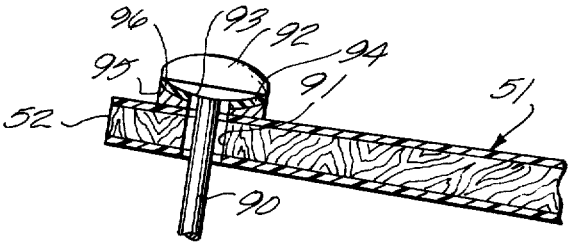
Fig. 14
Fig. 15
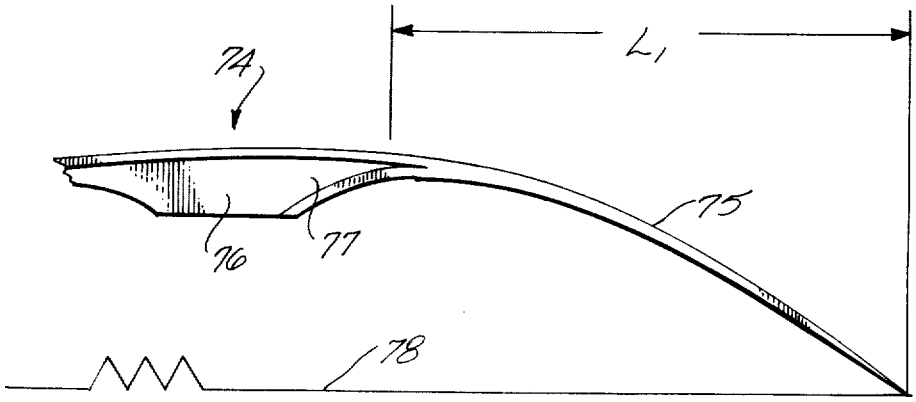

ARCHER'S BOW WITH INTERMEDIATELY PIVOTED LIMBS

BACKGROUND OF THE INVENTION

1. Field of the Invention

This invention pertains to archers' shooting bows. More particularly, it pertains to such bows in which the bow limbs are arranged to flex in a manner analogous to simply supported beams rather than as cantilever beams.

2. Review of the Prior Art

So far as is known, all archers' shooting bows, from earliest primitive time, have used limbs which flex as cantilever beams. This is the case in simple bows, recurved bows, crossbows and in the more recently developed compound bows such as are shown in U.S. Pat. No. 3,486,495. Archery is a rapidly expanding sport worldwide, and improvements in bows are continually being sought to improve their performance. This invention provides substantial performance improvements in archers' shooting bows.

The present invention is believed to have increased significance when used in a compound bow, but the invention can be used to advantage in more conventional bows such as recurved bows. Compound bows involve complex rigging of the bowstring over pulleys carried by the bow limbs. This rigging makes it virtually impossible to unstring the bow when it is not in use. Thus, the limbs of compound bows are always under significant stress, which eventually leads to a degradation of the limb fibers and a reduction in the bow weight (the amount of force needed to flex the bow limbs to a condition of full draw of the bowstring) with time for a given setting of the bow. This means that periodic retuning of compound bows is needed to maintain desired performance levels. The use of this invention in a compound bow makes it possible to effectively unstring the bow during periods of nonuse, thus enabling the limbs to relax essentially entirely.

The present invention provides other advantages which are set forth in the following detailed description of preferred embodiments thereof.

SUMMARY OF THE INVENTION

This invention provides substantial improvements in the performance of shooting bows. The structural and procedural aspects of the invention are simple, effective, efficient and reliable. This invention provides many advantages over conventional bows and, as noted, when used in the context of a compound bow, allows the bow to be effectively unstrung and essentially entirely relaxed during periods when the bow is not in use. Some of the advantages of the present invention, as more fully set forth below, include a reduced tendency of the bow to jump from the user's hand upon release of the drawstring, due to reduced critical mass of the forward moving portions of the bow, and increased bow tip speed upon release of the bowstring. The invention also enables a user to adjust the position of the bowstring laterally of the handle, i.e., to adjust the degree of center shot of the bow.

Generally speaking, this invention provides a shooting bow which comprises a rigid elongate handle riser assembly having opposite ends and a central handle portion. An elongate resilient limb is disposed at one end of the handle riser assembly. The limb defines an outer limb tip at one of the opposite ends of the bow. A bowstring is coupled between the outer limb tip and the other end of the bow adjacent a rear face of the handle riser assembly. The bowstring has a nocking point adapted to be drawn from a rest position to a drawn limb-flexing position upon application of drawing force thereto. Mounting means connect the limb only at a location intermediate its length to the adjacent end of the handle riser assembly for hinging motion of the limb relative to the assembly about an axis which is substantially perpendicular to the plane in which the bowstring moves in being drawn from its rest to its drawn position. The limb thereby has an inner tip adjacent a front face of the handle riser assembly proximate the handle portion of the assembly in addition to an outer tip at the end of the bow. Tether means are connected between the limb inner tip and the handle riser assembly for constraining the inner tip from movement away from the assembly in response to application of drawing force to the bowstring. As the bow is drawn the limb flexes on both sides of its location of hingeable connection to the assembly in a manner which is analogous to a simply supported beam loaded by a concentrated load at such location.

DESCRIPTION OF THE DRAWINGS

The above-mentioned and other features of this invention are more fully set forth in the following detailed description of the presently preferred embodiments of this invention, which description is presented with reference to the accompanying drawings, wherein:

FIG. 9 is an enlarged fragmentary elevation view taken within the circle 9 in FIG. 4;

FIG. 10 is a fragmentary elevation view of another mounting of a limb to the handle riser assembly;

FIG. 12 is a fragmentary elevation view of another tether adjusting mechanism;

FIG. 13 is an enlarged fragmentary view, partially in section, of still another tether adjusting mechanism;

FIG. 14 is an enlarged fragmentary view, partially in section of a different connection of a tether to a limb inner tip;

FIG. 15 is a schematic elevation view of a limb of a bow of conventional construction;

FIG. 18 is an elevation view, partially in section, of another tether means.

DESCRIPTION OF THE ILLUSTRATED EMBODIMENTS

Figure 1:
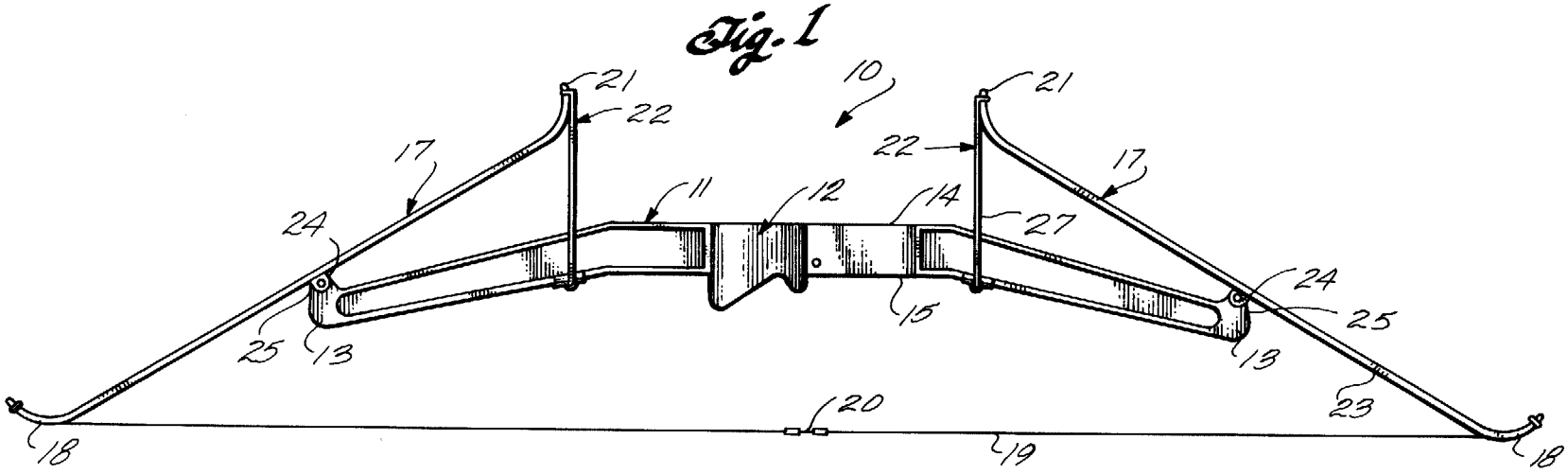
FIG. 1 is an elevation view of a simple bow, akin to a recurved bow, according to this invention.

An archer's shooting bow 10 is shown in FIG. 1 and includes an elongate rigid handle riser assembly 11 which defines a handle 12 centrally between the opposite ends 13 of the riser assembly. The riser assembly has a forward face 14 which is of generally convex configuration and a concave rear face 15. Handle 12 is adapted to be engaged in and supported by a hand of the user of the bow. The riser assembly can be built up out of wood, or it can be defined by either a metal casting or a fabricated metal structure.

A pair of substantially identical elongate resilient limbs 17 are also components of bow 10. A limb is disposed at each end 13 of the riser assembly; the limbs define a pair of spaced outer limb tips 18 at opposite ends of the bow. A bowstring 19 is coupled between the limb outer tips to pass adjacent the riser assembly rear face 15. The bowstring has a nocking point 20 appropriately defined on the bowstring relative to handle 12. The bowstring is adapted to be drawn from a rest position (see FIG. 1) to a drawn limb-flexing position upon application of drawing force to the bowstring at the nocking point in a direction away from handle 12.

Each limb 17 is connected to the corresponding end of the riser assembly so that the limb is movable in a hinging manner relative to the handle assembly. Each limb hinges about an axis which is substantially perpendicular to the plane in which the bowstring moves in being drawn from its rest position to its drawn position. This hinging connection of each limb to the riser assembly is the only connection of the limb to the assembly, save for the connection of the inner tip 21 of each limb to the riser assembly by an inelastic tether 22. Each limb is hingeably connected to the riser assembly at a location along the limb intermediate its length between the outer and inner tips of the limb. Thus, as shown best in FIGS. 1, 2 and 9, for example, each limb 17 has a rear face 23 which carries a pair of trunions 24 which, in the mounting of the limb to the riser assembly, are disposed on opposite sides of a gudgeon 25 formed at the end of the riser assembly to project from the front face 14 of the assembly. A hinge pin 26 rotatably couples the trunions and the gudgeon.

Figure 2:
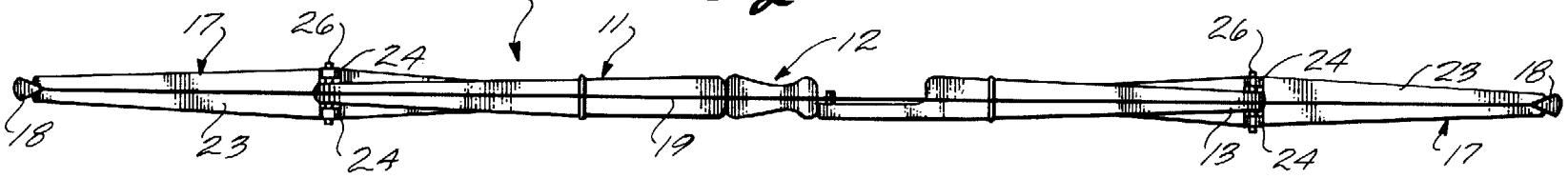
FIG. 2 is a rear elevation view of the bow shown in FIG. 1.

As shown in FIG. 1, the hingeable connections of limbs 17 to riser assembly 11 are located at the mid-length of each limb. Accordingly, each limb is divided by the location of its mounting to the riser assembly into an outer leg, between the hinge axis and the outer tip of the limb, and an inner leg, between the hinge axis and the inner tip 21 of the limb. Limbs 17, as shown in FIG. 2, are symmetrical about the respective hinge axes, and preferably are of uniform thickness along their length, but are of variable width, the widest part of the limb being at its midpoint where it is hinged to the riser assembly. The variation in width of the limb is defined so that, as the bowstring is drawn in use of the bow, the limbs are stressed substantially uniformly along their lengths.

Limbs 17 preferably are of a laminated construction having outer layers of a suitable fiberglass material and an inner layer or layer of wood; see FIG. 14. The techniques for laminating bow limbs are well known, and any suitable technique used to define the flexing limbs of conventional bows, i.e., bows known prior to the present invention, may be used to make the limbs of a bow of the present invention.

Figure 5:
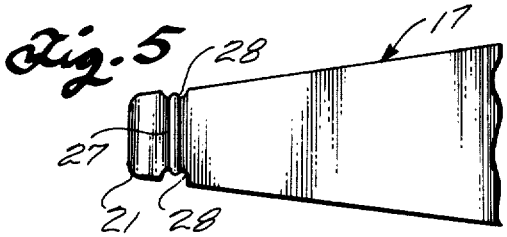
FIG. 5 is an enlarged fragmentary view of an inner tip of a limb of the bow shown in FIG. 3.

A tether 22 is connected between the inner tip 21 of each limb and the riser assembly at a location on the riser assembly adjacent to the inner limb tip. A primary purpose of the tethers is to constrain the inner limb tips from moving away from the riser assembly as the bowstring is drawn; the tethers may also be referred to as limb restrainers or as restraining means. The tethers are so constructed and so coupled to the limb inner tips that the tethers impose upon the limb inner tips no significant restraints against rotation of the limbs relative to the tethers. Preferably the tethers are defined by a loop of flexible metal cable 27 which preferably is enclosed in a smooth plastic sheath. The tether cable loops are connected to the inner limb tips in the manner shown in FIG. 5 by engaging the loops in notches 28 formed in the opposite edges of the limbs adjacent the extreme inner end of the limb. Each tether cable 27 passes across the rear face 15 of the riser assembly. Preferably, as shown best in FIG. 12, each tether loop 27 passes through a tube 29 which is secured to a small plate 30. In the area in which the tether cable passes across the rear face of the riser assembly, a piece of suede 32 or the like is secured to the rear face of the riser assembly so that the tether cable does not chafe against the riser assembly. Also, the suede 32 provides substantial friction between itself and the adjacent face of plate 30, thereby to fix the location at which the tether loop passes across the rear face of the riser assembly.

Limbs 17 may be planar between their inner and outer tips, but it is preferred, in a simple bow 10 construction according to this invention, that the inner and outer limb tips be curved away from the riser assembly in a manner analogous to the curvature of the outer tips of the limbs in a recurved bow; see FIG. 1.

The geometry of limbs 17 and of the riser assembly, the effective length of bowstring 18 and the effective lengths of tethers 22 establish the extent to which limbs 17 are stressed (flexed) when the bow is strung, as shown in FIG. 1, and the bowstring is in its rest position. This at-rest stress condition of the limbs, in combination with the flexural stiffness (spring rate) of the limbs, determines the force which must be applied to the bowstring at nocking point 20 to draw the bowstring to its fully drawn position. This force is referred to as the "weight" of the bow. Thus, a bow which requires the application to the bowstring of a force of 65 pounds to cause the bow to be operated to its drawn condition is said to be a bow having a weight of 65 pounds.

Figure 11:
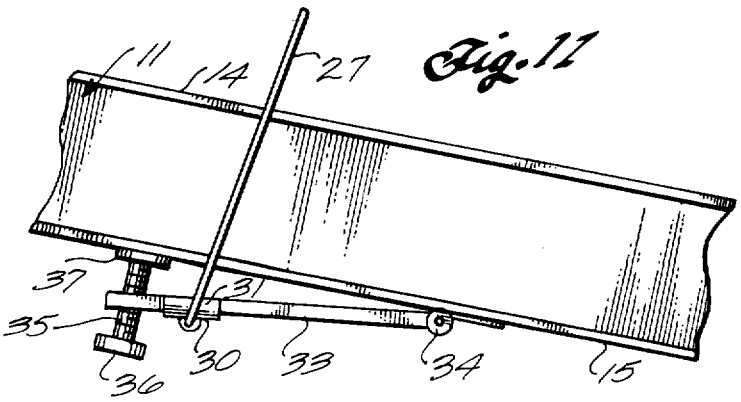
FIG. 11 is a fragmentary enlarged elevation view of a tether adjusting mechanism for the bow according to this invention.

The weight of bow 10 may be adjusted by varying the effective lengths of tethers 22. While various tether length adjusting arrangements and procedures are within the scope of this invention, such as the incorporation of a turnbuckle in one or both of tethers 22, presently preferred weight adjusting mechanisms are shown in FIGS. 11, 12 and 13. The weight adjusting mechanism shown in FIG. 11 includes an adjustment plate 33 which is pivoted to riser assembly rear face 15 by a hinge 34 at one end of the plate. The other end of the plate defines a threaded hole which cooperates with a screw 35 having an operating knob 36 at one end. The other end of the screw is rotatably held captive in a keeper 37 secured to the rear face of the riser assembly. Tether loop 27 is engaged with the adjustment plate between the opposite ends of the plate, but preferably adjacent to the screw, via suede pad 31 and a tether loop guide assembly including a tube 29 and a plate 30, all as shown in FIG. 11. From an examination of FIG. 11, it will be apparent that, by turning knob 36, the spacing between the rearmost extent of tether loop 27 and the rear face of the riser assembly can be adjusted, thereby to adjust the proximity of the inner tip of the corresponding limb to the front face 14 of the riser assembly, thereby to adjust the weight of the bow by variation of the preset force in the bow when the bowstring is at its rest position.

Another weight adjusting mechanism is shown in FIG. 12 and is defined by a pair of cooperating overlapping and oppositely oriented wedges 38 which are interposed between suede pad 32, connected to the riser assembly rear face, and plate 30. The wedges preferably are fabricated of a material, such as hard rubber, which has a substantial coefficient of friction with itself. By appropriate variation of the relative positions of the wedges, the spacing between plate 30 and suede pad 32 may be adjusted, thereby to adjust the weight of the bow.

Another bow weight adjusting mechanism, useable in a bow according to this invention, is shown in FIG. 13. This mechanism includes an eyebolt 39 having an elongate threaded shank 40 which extends from the eye 41 of the eyebolt. Eye 41 is disposed adjacent the front face 14 of user assembly 11. Shank 40 extends through an elongate slot opening 42 formed in the front face of the riser assembly. In a prototype bow according to this invention, the riser assembly has a cross-sectional configuration adjacent its ends, on opposite sides of handle 12 and the shooting window above the handle, which resembles an I-beam having a web 43 and flanges defining the riser assembly front and rear faces; in this prototype, the opening 42 is formed in the front flange closely adjacent web 43 with its elongate extent parallel to the web. An opening 44, oversized relative to shank 40, is formed in the rear face of the riser assembly on a line which passes from the limb inner tip in its operating position through opening 42. An annular bearing member 45 is carried by the riser assembly rear face concentric to opening 44 and has a spherically curved concave surface opening away from the riser assembly. An annulus of self-lubricating material 46, such as a fluorochloroethylene material, is carried by this spherical surface to cooperate with a similarly spherically curved convex front face on a circumferentially knurled adjusting knob 47 threaded onto shank 40 which passes through openings 42 and 44. A jamb knob 48 is also threaded onto shank 40 rearwardly of the adjusting knob to about the rear face of the adjusting knob to lock the adjusting knob against rotation about shank 40. Knob 47 preferably is of larger diameter than the jamb knob 48. Tether cable 27 is connected between eye 41 and the adjacent inner tip of the pivotably supported limb of the bow. By turning knob 47, the spacing of eye 41 from the riser assembly front face, and thereby the effective length of the tether between the riser assembly and the limb inner tip, can be adjusted to vary the weight of the bow. The self-lubricating bearing between knob 47 and the riser assembly enables this mechanism to adjust itself to the line of force applied to it at any time.

It will be apparent that a weight adjusting arrangement is required only in combination with one of tethers 22 to provide for adjustment of the bow weight. When the bow is strung, a variation in the proximity of one inner limb tip relative to the front face of the riser assembly results in the balanced distribution of the preload force of the bow between the two limbs in view of the interconnection of the limb outer tips by bowstring 19. After an adjustment of the weight of the bow by operation of any of the mechanisms described above or otherwise, the preload force of the bow may be balanced between the limbs merely by drawing the bow two or three times to work the limbs and their mountings to the riser assembly.

Figure 3:
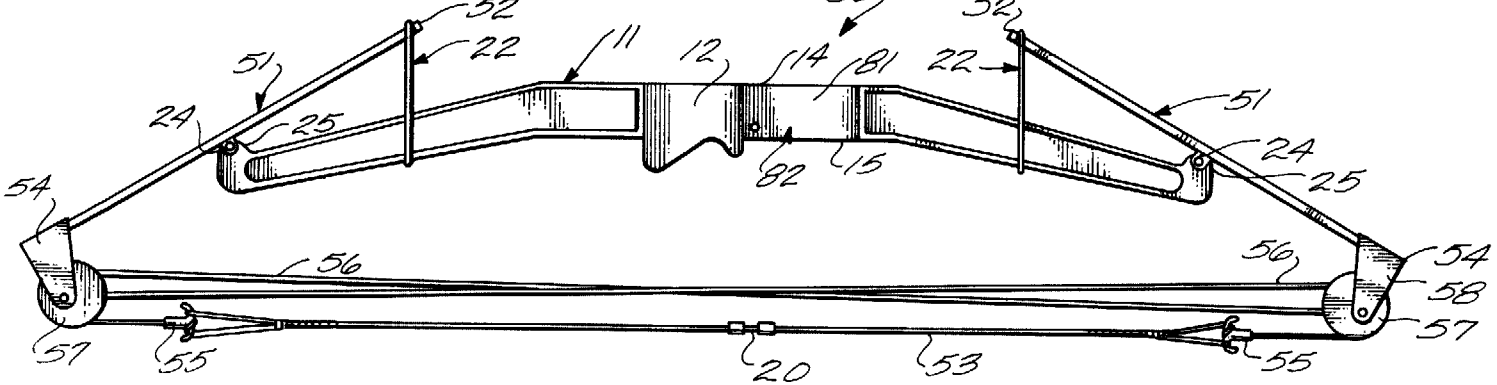
FIG. 3 is an elevation view of a compound bow according to this invention.
Figure 4:
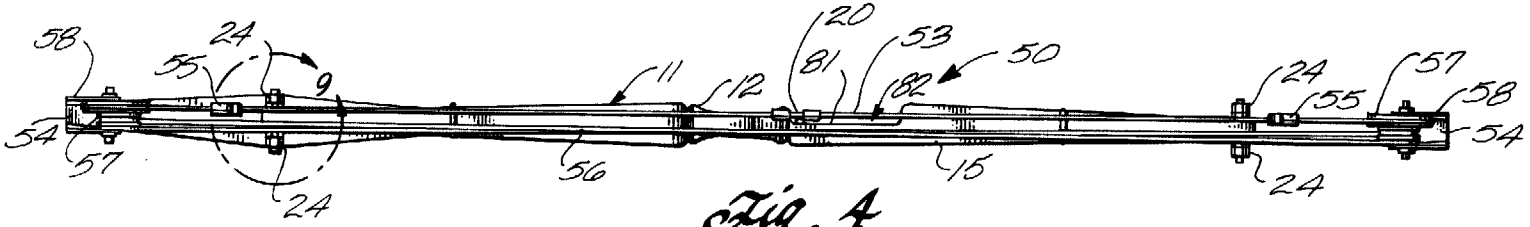
FIG. 4 is a rear elevation view of the bow shown in FIG. 3.

A compound bow 50, according to this invention, is shown in side elevation and in rear elevation in FIGS. 3 and 4, respectively. Bow 50 includes a handle riser assembly 11 which is essentially identical to the handle riser assembly of bow 10 shown in FIGS. 1 and 2. The principal difference between compound bow 50 and bow 10 is in the configuration of limbs 51 of bow 50 as opposed to limbs 17 of bow 10, and in the manner in which the bow string is supported between the outer tips of limbs 51.

The limbs 51 of bow 50 are preferably planar as shown in FIG. 3, whereas limbs 17 of bow 10 are shown in FIG. 1 to be curved at their inner and outer tips away from handle riser assembly 11. Limbs 51 may also be shorter and of greater flexural stiffness than limbs 17. Limbs 51 have inner tips 52 which are coupled to the handle riser assembly via tethers 22 in accord with the foregoing description, the coupling of the tethers to the limbs inner tips being as described above and as shown in FIG. 5. Tethers 22 are engaged with the handle riser assembly in any of the manners described above with respect to FIGS. 1 and 2, 11, 12 and 13, as desired.

A bow string 53 of compound bow 50 is not connected directly to the outer tips 54 of limbs 51, but rather is connected as by coupling hooks 55 at its opposite ends to ends of a pair of cables 56. Each cable 56 has one end connected to a coupling hook 55 from which it passes to engagement with an eccentric pulley wheel 57 rotatably mounted to the outer tip of the adjacent limb 51. Compound bow 50 is of the two-wheel type in which the end of each cable 56, opposite from its coupling hook 55 is connected to the axle of the eccentric pulley remote from its coupling hook; that is, the cable 56 which extends from the coupling hook 55 at the right end of the bow, as shown in FIG. 3, passes over the right eccentric pulley wheel 57 and has its opposite end connected to the axle of the left eccentric pulley wheel. As shown in FIG. 3, pulley wheels 57 are rotatably mounted eccentrically of their geometric centers in brackets 58 which are carried by the outer tips of limbs 51. It is within the scope of this invention, however, that the pulley wheels may be connected directly to the outer tips of the limbs, in which case the limbs at their outer tips would be defined in the well known split limb configuration.

A two-wheel compound bow 50 is shown in FIGS. 3 and 4 solely for the purposes of example. Those familiar with compound bows will readily appreciate that the compound bow could be of the four-wheel type, rather than the two-wheel type, if desired. Particularly where the compound bow is of the two-wheel type, the eccentric pulley wheels preferably are of the stepped diameter type which are encountered in bows of various manufacture presently commercially available. The basic structural and operational characteristics and features which distinguish compound bows from more conventional bows are well known; see, for example, U.S. Pat. No. 3,486,495.

A common characteristic of existing compound bows is that once rigged, i.e., once strung by connection of cables 56 and bow string 53 to the pulleys of the compound bow, they are not unrigged when not in use unless the user knows that the period of non-use of the bow is to be extensive. Accordingly, compound bows have the limbs thereof constantly significantly stressed under preload forces which can be a substantial portion of the weight of the bow. The continuous application of these preload stresses to the limbs of existing compound bows leads to a gradual degradation of the fibers of the bow limbs. This requires periodic retuning of compound bows so that the desired weight of the bow may be maintained.

Figure 6:
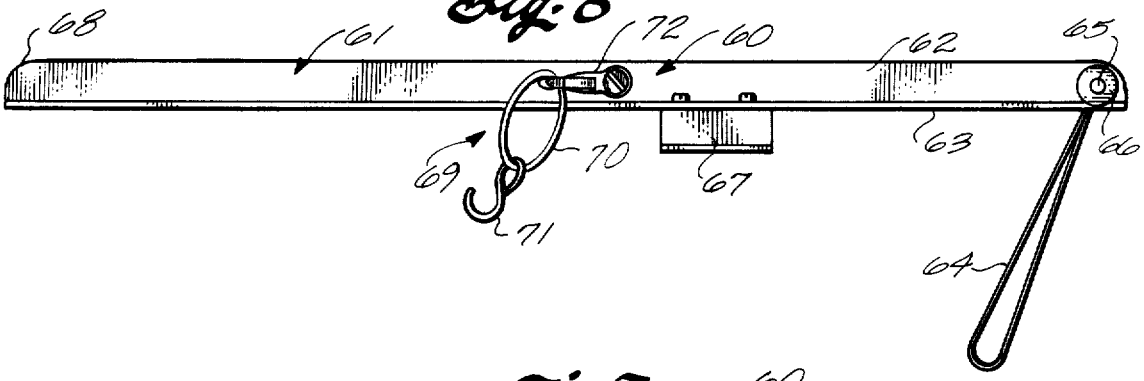
FIG. 6 is a side elevation view of a lever member provided as an accessory for the compound bow of FIG. 3.
Figure 7:
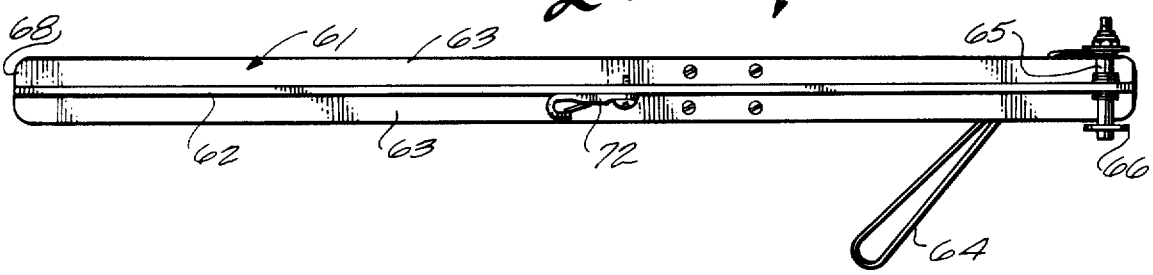
FIG. 7 is a top view of the lever member shown in FIG. 6.
Figure 8:
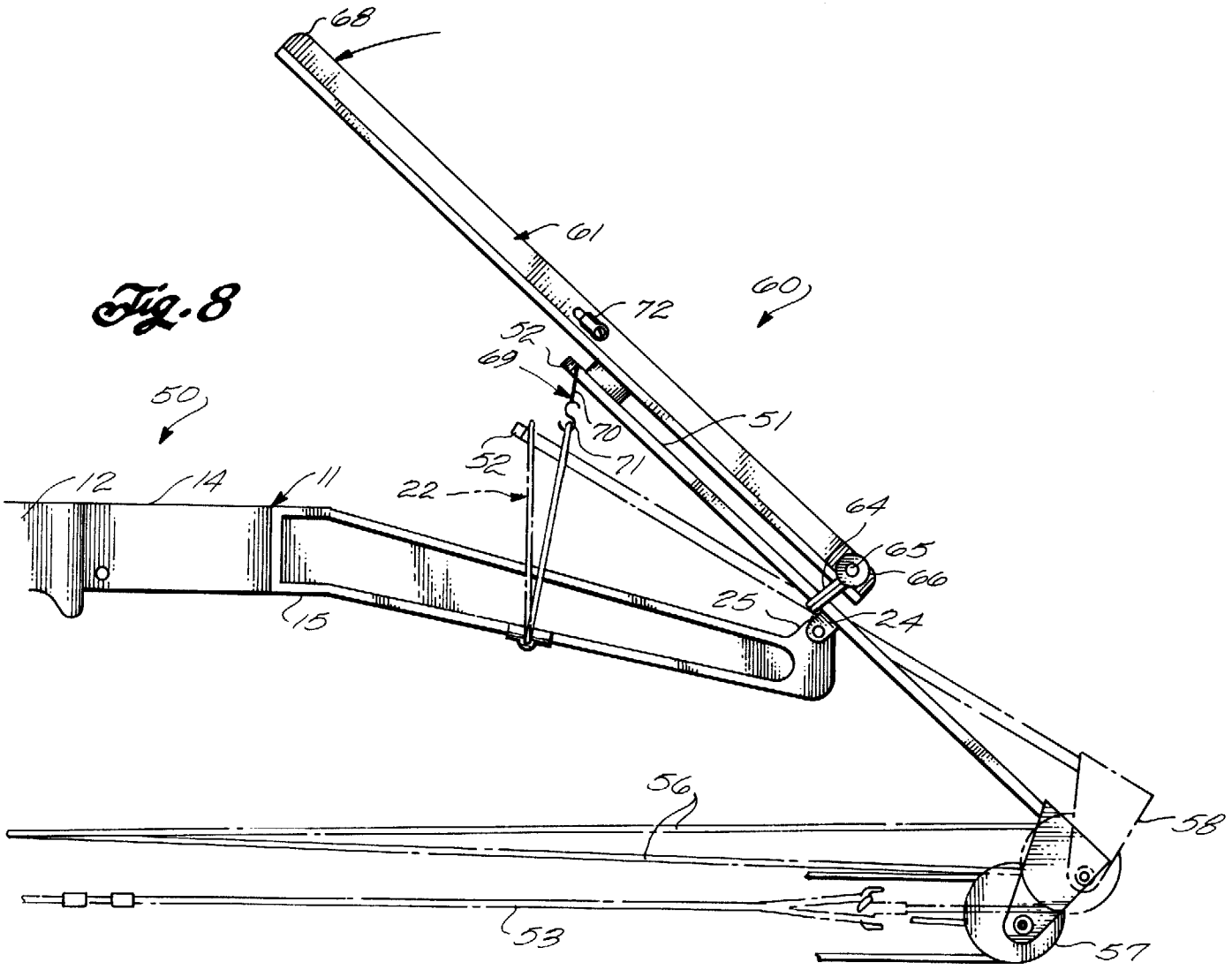
FIG. 8 is an elevation view showing the use of the lever accessory to effectively unstring the compound bow shown in FIG. 3.

Inasmuch as limbs 51 of compound bow 50 are hingeably connected to the riser assembly and the inner tips of the limbs are accessible in a spaced relation from the riser assembly, this situation enables the bow to effectively be unstrung when not in use. The manner by which bow 50 is unstrung is illustrated in FIGS. 6, 7 and 8. FIGS. 6 and 7 pertain to an accessory tool useful to unstring the bow; the use of this tool being illustrated in FIG. 8.

A loading lever 60 is provided as an accessory to the compound bow and is shown in FIGS. 6 and 7. The lever has an elongate body 61 which may be defined from a length of extruded aluminum T-section, for example, having a web 62 and coplanar flanges 63 extending from opposite sides of the web along one edge thereof. The lever preferably has a length between its opposite ends which is at least as great as the length of a limb 51. A loop of stout cord 64 is connected permanently to one end of the lever, as to one end of a pin 62 which is carried by web 65 and extends laterally from either side of the web. Loop 64 is of sufficient length that, when the corresponding end of the lever is placed adjacent a hinge point of limb 51, as shown in FIG. 8, adjacent the front face of the limb, the loop may be passed across the rear face of the limb and engaged with the opposite end of pin 65. The end of pin 65 to which loop 64 is not permanently connected preferably carries a keeper disc 66 to prevent loop 64 from slipping off the pin during the use of the loading lever. A resilient bearing block 67 is carried by the flanges of the loading lever on the side thereof opposite from web 62 at a location intermediate the ends of the loading lever. The distance between pin 65 and the most remote end of the loading block should be less than the distance along limb 51 from its hinge point to the notches 28 by which the tether is connected to the limb inner tip in the manner shown in FIG. 5. Thus, when the loading lever is engaged with the limb in the manner shown in FIG. 8, the bearing block 67 does not obstruct access to the location where tether 22 is connected to the limb.

To effectively unstring compound bow 50, the bow is suitably supported, as face up across the knees of the user. The loading lever is engaged with one of the limb in the manner described above, i.e., by passing loop 64 across the rear face of the limb immediately adjacent to the hinge point of the limb to the riser assembly, and the bearing block is brought into engagement with the front face of the limb adjacent the connection of the tether to the limb. Force is then applied to the free end 68 of the loading lever opposite from loop 64 to cause the inner tip of the limb to be deflected toward the handle riser assembly. Such loading of the lever is possible since the engagement of loop 64 around the rear face of the limb and back to pin 65 prevents the lever from tilting about the bearing block as a fulcrum. Force is applied to the loading lever to deflect the limb inner tip sufficiently that the tether loop 22 may be disengaged from the limb. A tether extender 69 is then engaged between the tether and the inner tip of the deflected limb via notches 28. The deflecting force applied to the loading lever is reduced to allow the limb tip to move away from the riser assembly by an amount afforded by the extended length of the tether. The extended length of the tether is such that it does not permit the limbs to fully relax but retains in the limbs a very light residual preload force which is sufficient to keep the compound bow actually strung, i.e., to prevent cables 56 from becoming unreeved from pulley wheels 57.

It will be appreciated that, in effectively relaxing bow 50, it is necessary to extend the length of only one of tethers 22. Due to the interconnection between the limbs via the bowstring and the rigging of the bow, a change in the loading of one limb is distributed evenly between the limbs.

The limb extender 69 may conveniently be provided as a small loop of stout chord 70 to which is connected a hook 71. Once a tether 22 has been disconnected from a limb inner tip following deflection of the limb inner tip from its normal preloaded state, shown in broken lines in FIG. 8, hook 71 is engaged with the tether loop and loop 70 is then engaged with the limb inner tip to allow the limb to hinge into its relaxed state shown in solid lines in FIG. 8. A clip 72 is secured to the loading lever to provide a convenient location for storage of the tether extender when it is not coupled between one of the limbs and its tether.

Figure 16:
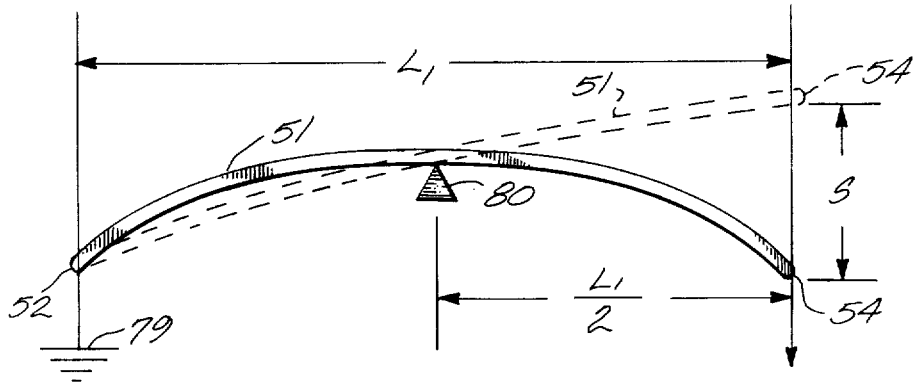
FIG. 16 is a schematic view illustrating that a limb of a bow of the present invention flexes in a manner analogous to a simply supported beam during use of the bow.

FIGS. 15 and 16 compare the deflection of a conventional cantilever bow limb and a pivoted bow limb according to this invention of equal length. As shown in FIG. 15, a common straight ended bow 74 has a limb 75 of length $L_1$ connected to the bow riser 76 via a fade-out portion 77 in which the thin flexing portion of the limb is merged into the more massive, essentially rigid riser. As bow string 78 is drawn, limb 75 deflects as a cantilever beam. FIG. 16, on the other hand, shows the deflection of bow limb 51, for example, having a length $L_1$ and a width and sufficient thickness to cause limb 51 to have a section at moment of inertia I equal to the effective section of inertia of cantilever bow limb 75. The inability of bow limb inner tip 52 to move away from the riser assembly to which it is hingeably mounted is represented in FIG. 16 by ground symbol 79, and the hingeable connection of limb 51 to its riser assembly is represented by a knife-edge fulcrum 80 at the midlength of the limb. The force which loads the limb at its outer tip 54 as the bow is drawn is represented in FIG. 16 by force F. For the purposes of the comparison afforded by FIGS. 15 and 16, it is assumed that the conventional bow 74 and the bow of which limb 51 is a component are similarly strung, i.e., are both strung in a compound manner as shown in FIGS. 3 and 4 previously described. It is also assumed that both bows have the same weight and draw length, and are made of the same material to have equal values of Young's Modulus E.

The deflection $\Delta$ of a cantilever beam of length 1 loaded by a concentrated load P at its free end is $\Delta = P1^3/3EI$. In this connection, it is assumed that limb 75 is of uniform cross-section along its length from fadeout portion 77 to the limb tip. The deflection of a beam of length 1 freely supported at its ends and loaded by a concentrated load P at its center is $\Delta = Pl^3/48EI$, i.e., a center loaded simply supported beam is given by the equation $\Delta = Pl^3/48EI$. From an examination of FIG. 16 it will be seen that limb 51 is loaded by force F=P in a manner fully equivalent to the loading of a simply supported beam subjected to a concentrated load at its midlength. In other words, the deflection of limb 51, i.e., the change in its curvature between its opposite ends, is the same in the case shown in FIG. 16 as when both ends of the limbs are freely supported and force F is applied to the midlength of the limb.

From the deflection relationships given above, it is apparent that the deflection of the tip of a cantilever bow limb is 16 times the deflection of the outer tip of an equivalent limb 51 according to this invention when limb 51 is hingeably coupled to a bow riser assembly 11 at the midlength of the limb. It follows that a limb in a bow according to this invention is more efficiently loaded than a conventional cantilever bow limb, and the total deflection experienced by limb 51 is distributed equally between the inner and the outer halves of the limb. It is also apparent that for a given bow weight, a significantly smaller mass of the bow moves rearwardly as the bow is drawn, and moves forwardly as the bowstring is released from a condition of full draw, as compared to the case in the conventional cantilevered bow limb. This means that the critical mass of that portion of a limb of a bow according to this invention which moves forwardly on release of the drawn bowstring is substantially less than the critical mass which moves forwardly as a conventional bow, regardless of how rigged, is released. Accordingly, there is considerably less tendency for a bow according to this invention to jump from the hand of a user upon release of the bowstring than is the case with a conventional bow, regardless of how rigged. Moreover, upon release of a drawn bow according to this invention, there is a portion of the pivoted limbs which tends to move rearwardly. Thus, that portion of each limb between its hinge point to the riser assembly and its inner tip has its own rearwardly moving critical mass which counteracts the forwardly moving critical mass associated with the outer half of the limb. This rearwardly moving critical mass partially affects the forwardly moving critical mass, thereby further reducing the tendency of the bow to jump from the hand of the user upon release of bowstring. This feature is a significant advantage over more conventional bows and results in increased accuracy in shooting.

It will also be observed from the foregoing deflection equations that the total distance traversed by the outer tips of a present bow, which move as the bowstring moves from its position of full draw to its normal at-rest position, is 1/16 that of the travel of a conventional limb tip. The nocking point of the bowstring moves the same distance in a bow according to this invention as in a conventional bow of equivalent weight and draw; this is so because draw is defined as a distance. There is thus a significant reduction in the extent to which the bowstring in a bow of this invention moves forwardly, as a unit, upon release of the bow from full draw, as compared to the case of a conventional bow, even though the nocking points in the two bows move the same distance, the draws of the two bows being equal. The reduced translatory motion of the bowstring in a bow of this invention further contributes to enhanced shooting accuracy, as compared to bows having cantilever limbs.

A compound bow acccording to this invention is far less susceptible to shooting inaccuracies due to torsional loading of the limbs than an equivalent bow having cantilevered limbs. The effective length of the limb susceptible to torsional loading having any significance upon the flight of the arrow is one-half that of the equivalent cantilever limb. Thus, a limb according to this invention has a signficantly increased torsional stiffness than an equivalent cantiliever limb. This feature makes it possible to provide, in a bow according to this invention, an adjustment for degree of center shot as shown, for example, in FIG. 9. Thus, the spacing of nocking point 20 relative to the face 81 of shooting window 82 (see FIGS. 3 and 4 immediately above handle 12) is adjustable in bow 50 to an extent much greater than can be accommodated in a bow of more conventional construction without encountering significiant problems of torsions in the bow limbs. Adjustablility of center shot in bow 50 is provided by defining trunions 24 so that the spacing between their opposing faces 84 is greater than the width of gudgeon 25 along hinge axle 26. The position of the limb relative to handle riser 11 along the hinge pin is adjustable by interposing shim washers 85 around the hinge pin between the trunions and the opposing surfaces of the gudgeon. In FIG. 9, limb 51 is shown to be symmetrically mounted to riser assembly 11 by the disposition of equal numbers of equal thickness shim washers between the gudgeon and the adjacent trunions. The degree of center shot of the bow can be adjusted by locating more or less of the shim washers to one side or the other of the gudgeon, thereby to shift the limb bodily laterally in either direction desired relative to the elongate extent of the riser assembly 11.

The enhanced torsional stiffness of the present bow limbs also makes it possible to increase the spacing axially of pulley wheels 57 of the location at which the compound rigging cables 56 engage the smaller and larger diameter portions of a stepped diameter eccentric pulley wheel without imposing objectionable torsional effects in the bow. This means that a greater lateral spacing, relative to the plane in which the nocking point moves between its drawn and rest positions, is possible in bows according to this invention than in more conventional bows having cantilever limbs. This means that the bow string of a compound bow according to this invention can be sufficiently spaced from the rigging cables to assure that there is no contact between the arrow and the rigging cables as the bow is shot. This further contributes to the enhanced shooting accuracy of a bow according to this invention.

Where the limb 17 or 51, for example, is of variable width, as shown in FIG. 9, for example, the limb can be designed to have uniform stress along its entire length when drawn. This uniform stress will give a longer life expectancy and a higher efficiency to the limb under flexing. In a conventional cantilever limb, flexing starts at the limb tips and terminates at the fade-out section as shown in FIG. 15. The sectional efficiency of a cantilever limb descreases as it approaches the limb fade-out.

A further feature of a bow of this invention results from the fact that the overall frontal area of forwardly moving deflecting sections of the bow limbs is reduced as compared with an equivalent bow of conventional configuration. This area reduction increases the bow tip velocity and efficiency due to a reduction in air resistance.

All of the above-described advantages of bows according to this invention follow from the fact that the bow limbs deflect in a manner analagous to the deflection of a simply supported beam loaded at a point intermediate the length of the beam. By definition, a simply supported beam is a beam which is so supported at its ends that there are no restraints imposed upon rotation of the beam. To the extent that the present bow limbs are subjected to restraints upon rotation at their inner tips, to the same extent the bow limbs behave as cantilever limbs. It is therefore important that the tethers which connect the limb inner tips to the handle riser assembly be arranged to impose no restraints upon the limbs which would inhibit angular motion of the limbs relative to the tethers. Limb tethers defined of flexible cable inherently provide this freedom from rotational constraint and are preferred for this reason, in addition to being simple, effective, and efficient. It will be appreciated, however, that limp inner tip tethers other than flexible cable loops may be used in bows according to this invention.

For example, as shown in FIG. 14, a tether rod 90 passes through an oversize hole 91 formed through limb 51, for example, adjacent its inner tip 52, and terminates in a head 92 having a diameter greater than that of hole 91. Head 92 has a sphericaly curved surface 93 facing toward the limb forward face. Spherical surface 93 cooperates with a mating spherical surface 94 on an annular bearing member 95 which is suitably affixed to the forward face of the limb concentric to hole 91. An annulus of self-lubricating material 96 is interposed between head 92 and the bearing member. The opposite end of tether rod 90 may be adjustably connected to the riser assembly, as in the manner shown in FIG. 13 as to the rear end of eyebolt 39. It will be appreciated that where a tether rod 90 is used, it is more difficult to effectively relax a compound bow.

Another non-cable limb restrainer and weight adjustment mechanism 120 is shown in FIG. 18 in a bow 121. Bow 121 has a handle riser 122 having at least one limb 17 mounted to it in the manner described above. A rigid limb restraining member 123 has one end pivoted, as at 124, to the handle riser at an end of a recess 125 formed in the handle riser and opening through a front face 126 of the riser. The axis of pivot 124 is parallel to the axis of hinging motion of limb 17 relative to the handle riser. Adjacent its movable end 127, the restaining member defines a plurality of notches 128 in that surface 129 of the restraining member which faces toward the handle riser. Each notch 128 has a knife-edge projection 130 extending into it at the corner of the notch away from pivot 124 where the notch opens to surface 129; the clearance between each knife-edge 130 and the opposing surface of the notch is greater than the thickness of limb 17 at its inner tip. The limb 17, adjacent its inner tip 21 and on the surface of the limb away from the handle riser, defines a transverse recess 131 aligned parallel to the axis about which the limb is hinged to the handle riser.

A torsion spring 132 is coupled between the restraining member and the handle riser in association with pivot 124. The spring urges the restraining member into a position in which the member is disposed in recess 125, which position is a retracted position of the restraining member, the recess 125 being long enough in the handle riser to accommodate the member.

In use of bow 121, the restraining member is moved about its pivot 124 out of its retracted position and engaged, via one of notches 128, with the inner tip of limb 17 as shown in FIG. 18; it will be appreciated that the limb, in such event, is flexed. The engagement of the restraining member with the limb is by way of the corresponding knife-edge 130 cooperating in limb recess 131. Thus, the restraining members holds the limb inner tip in position a selected distance (related to the desired weight of the bow) from the handle riser without confining the limb inner tip from rotating in the notch relative to the restraining member. The bias of spring 132 holds the restraining member in engagement with the limb inner tip.

The weight of bow 121 is adjustable by selection of the notch in the restraining member in which the limb inner tip is engaged.

Figure 17:
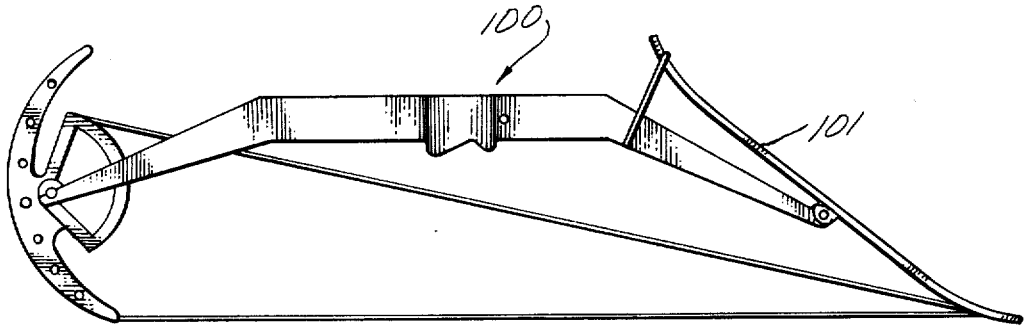
FIG. 17 is an elevation view of a bow having only a single working limb.

An innovative bow having only a single flexing limb has recently been developed and commercially introduced. This bow is marketed under the trademark DYNABO. As shown in FIG. 17, the present invention is applicable to a bow 100 of the DYNABO type having a single working limb 101. Inasmuch as the DYNABO is extensively described in the August 1977 issue of BOW AND ARROW, available on news stands during June 1977, the description of bow 100 herein is confined to the illustration of FIG. 17.

DYNABO single limb bows are manufactured by Martin Archery, Inc., Route 5, Box 127, Walla Walla, Washington 99362, and under License by Graham's Custom Bows, P.O. Box 1312, Fontana, California 92335.

Where weight adjustment is desired in a two limb bow according to this invention, it may be desirable to provide a weight adjusting mechanism in conjunction with the inner tip of each working limb. As noted above, the weight adjustment of the bow can be effected only with respect to one of the working limbs. The provision of a weight adjustment mechanism in association with each limb inner tip may be desired in order to provide precise control over the tiller of the bow in combination with weight adjustment.

Bows 10, 50 and 100, as illustrated in the accompanying drawings, have their limbs hinged to the handle riser assemblies at the midpoints of the limbs; this is the presently preferred geometry for a bow limb according to this invention. It is within the scope of this invention, however, that the point at which a limb is hingeably coupled to its riser assembly can be different from the midpoint of the limb. It is also within the scope of this invention that the mounting geometry of one limb of bows 10 and 50, for example, can be different from the mounting geometry of the other limb to the riser assembly. The limbs in a doubly limbed bow of this invention can be different from each other as to length, width, as well as stiffness, if desired.

A connection of the working limbs of the present bows to the handle riser assemblies via hinge pins is preferred. It is within the scope of this invention that other connections of the limbs to the riser assemblies may be used. Thus, FIG. 10 shows a bow 110 in which a limb 111 is pivotably mounted to riser assembly 11 via a knife-edge fulcrum. The outer end of the riser assembly defines a knife-edge projection 112 which extends forwardly from the front face 14 of the riser assembly. The knife-edge projection cooperates in a notch 113 defined in a built-up section 114 on the rear face of the limb. The length of section 114 along the elongate extent of the limb is kept as short as possible so as not to detract from the beam deflection characteristics of the limb. The knife-edge fulcrum hinging arrangement, shown in FIG. 10, can be used to advantage in a compound bow according to this invention particularly well since a compound bow can be relaxed as described above and still have a light residual load imposed upon the limbs sufficient to maintain the limbs in engagement with the knife edges. The knife-edge hinging connection of the limbs to the riser assembly in bow 110 also provides a continuous spectrum of center shot adjustment capability.

A further advantage of bows according to this invention is the simplicity with which the limbs may be manufactured. The limbs may be made of uniform thickness. This enables the limb laminate to be glued up in sheets and then cut from the sheets, resulting in efficient use of the sheet material. Conventional limbs, on the other hand, are difficult to build up at the root transitions, i.e., in the fade-out portions.

In view of the foregoing description, it is apparent that the present bow has limbs which differ significantly from conventional cantilever limbs. The present limbs are pivotally connected to the handle riser at a location intermediate with the lengths of the limbs. Accordingly, the limbs flex or work on opposite sides of the location of their connection to the riser assembly. The advantages of the present bows include greater velocity of the bow outer tips (which in turn means greater arrow velocity), greater efficiency of the bow in terms of conversion of potential energy stored in the bow to kinetic energy of the arrow, enhanced ability to adjust the acceleration and velocity curves descriptive of energy transfer from the bow string to the arrow, the ability to effectively unstring the bow where the bow is of the compound type, reduction in the true weight of the bow, enhanced stability and accuracy of the bow due to reduced mass of forward moving portions of the bow upon release of the bowstring and lower inertia in the forward moving portions of the bow, enhanced ability to accommodate torque in the limbs due to their reduced length and increased width, and enhanced adjustability of the bow in several respects.

The invention has been described above with reference to presently preferred embodiments of the invention and various ones of its many features. The foregoing description has not been presented as a catalog exhaustive of all forms which bows according to this invention may take. Accordingly, workers skilled in the art to which this invention pertains will readily appreciate that variations, alterations or modifications in the structures, procedures, and arrangements described above may be practiced without departing from the scope of this invention. Thus, the foregoing description should not be read as limiting the scope of this invention to less than the fair scope of the following claims.

What is claimed is:

1. A shooting bow comprising a rigid elongate handle riser assembly having opposite ends and a central handle portion, an elongate resilient limb at one of the ends of said assembly, the limb being resilient over a substantial portion of its length and defining an outer limb tip at one of the opposite ends of the bow at one of the opposite ends of the limb, a bowstring coupled between the outer limb tip and the other end of the bow adjacent a rear face of the assembly, the bowstring having a nocking point adapted to be drawn from a rest position to a drawn, limb-flexing position upon application of drawing force thereto, mounting means connecting, (a) the limb at a location intermediate that portion of the limb's length which is resilient to, (b) the respective end of said assembly for hinging motion of the limb relative to the assembly as the bowstring is drawn and about an axis substantially perpendicular to the plane in which the bowstring moves in being drawn from its rest to its drawn position, the limb having an inner tip adjacent a front face of the assembly proximate the handle, and tether means connected between the limb inner tip and the assembly for constraining the inner tip from movement linearly relative to the assembly in response to application of drawing force to the bowstring during which the limb experiences substantial flexing at locations therealong on opposite sides of said location of connection of the limb to the riser assembly for storage of substantial energy in the limb on opposite sides of said location.

2. A bow according to claim 1 wherein the tether means is so connected to the inner limb tip as to impose upon the limb no significant constraint upon rotation of the adjacent inner limb tip portion of the limb relative to the tether means.

3. A bow according to claim 2 wherein the tether means is comprised of a flexible cable.

4. A bow according to claim 3 wherein the tether means is comprised of a loop of flexible cable engaged with the inner tip of the limb and passed across the rear face of said assembly.

5. A bow according to claim 1 including adjusting means cooperable with the tether means for effectively varying the length of the tether means to adjust the distance between the inner limb tip and the assembly, thereby to adjust the weight of the bow.

6. A bow according to claim 5 wherein the tether means is comprised of a loop of flexible cable engaged with the inner tip of the limb and passed across the rear face of said assembly, and the adjusting means comprises means cooperating between the assembly and the loop operable for varying the distance between the assembly rear face and the loop.

7. A bow according to claim 6 wherein the adjusting means comprises wedge means engaged between the rear face of the riser assembly and the cable.

8. A bow according to claim 6 wherein the adjusting means comprises a lever hingedly coupled at one end thereof to the rear face of the riser assembly, the lever at a location spaced from the one end thereof being engaged with the cable between the cable and said rear face, and screw means coupled between the lever and the riser assembly for hinging the lever toward and away from the assembly rear face.

9. A bow according to claim 5 wherein the tether means comprises a length of flexible cable connected to the limb inner tip and extending toward the riser assembly, and the adjusting means comprises screw means coupled between the cable and the riser assembly.

10. A bow according to claim 1 wherein the limb is of essentially constant thickness along its elongate extent.

11. A bow according to claim 10 wherein the limb is of varying width along its elongate extent.

12. A bow according to claim 11 wherein the width variation of the limb is defined to cause the limb to experience substantially constant stress along its length during flexing of the limb.

13. A bow according to claim 1 wherein the said location divides the limb into an outer resilient leg between said location and the outer limb tip and into an inner resilient leg between said location and the inner limb tip.

14. A bow according to claim 13 wherein the limb is of recurved configuration in its outer leg.

15. A bow according to claim 13 wherein the limb in a fully relaxed condition thereof is straight.

16. A bow according to claim 13 wherein the bow is a compound bow, and including eccentric pulley means carried by the outer leg of the limb for coupling the bowstring to the limb.

17. A bow according to claim 16 including an accessory useful for effectively unstringing the bow and for substantially relaxing the limb when the bow is not in use, the accessory comprising a lever releasably engageable with the inner leg of the limb and operable for flexing the limb to move the inner tip toward said assembly whereby the tether means can be disengaged from the tip, and a tether extender connectible between the tether means and the limb inner tip.

18. A bow according to claim 13 wherein the inner and outer legs of the limb are of essentially equal length.

19. A bow according to claim 18 wherein the limb is essentially symmetrical about said location.

20. A bow according to claim 1 wherein said mounting means includes means operable for adjusting the position of the limb relative to said assembly in a direction along the limb hinge axis substantially normal to said plane.

21. A shooting bow comprising a rigid elongate handle riser assembly having opposite ends and a central handle portion, a pair of elongate resilient limbs disposed one at each of the ends of said assembly, the limbs being resilient over a substantial portion of their lengths and defining outer limb tips at the opposite ends of the bow at the respective opposite ends of the limbs, a bowstring coupled between the outer limb tips adjacent a rear face of the assembly, the bowstring having a nocking point adapted to be drawn from a rest position to a drawn, limb-flexing position upon application of drawing force thereto, mounting means connecting, (a) each limb at a location intermediate those portions of the lengths of the limbs which are resilient to, (b) the respective end of said assembly for hinging motion of the limb relative to the assembly as the bowstring is drawn and about an axis substantially perpendicular to the plane in which the bowstring moves in being drawn from its rest to its drawn position, each limb having an inner tip adjacent a front face of the assembly proximate the handle, and tether means connected between the limb inner tips and the assembly for constraining the inner tips from movement linearly relative to the assembly in response to application of drawing force to the bowstring during which the limits experience substantial flexing at locations therealong on opposite sides of the said locations of connections of the limbs to the riser assembly for storage of substantial energy in the links on opposite sides of the locations.

22. A bow according to claim 21 wherein the tether means are connected to the inner limb tips in such manner as to impose upon the limbs no significant constraints upon rotation of the adjacent inner limb tip portions of the limbs relative to the tether means.

23. A bow according to claim 21 wherein the tether means are comprised of flexible cables.

24. A bow according to claim 21 including adjusting means cooperable with at least one of the tether means for effectively varying the length of the one tether means to adjust the distance between the corresponding inner limb tip and the assembly, thereby to adjust the weight of the bow.

25. A bow according to claim 24 wherein the one tether means is comprised of a loop of flexible cable engaged with the inner tip of the limb and passed across the rear face of said assembly and the adjusting means comprises means cooperating between the assembly and the loop operable for varying the distance between the assembly rear face and the loop.

26. A bow according to claim 25 wherein the adjusting means comprises wedge means engaged between the rear face of the riser assembly and the cable loop.

27. A bow according to claim 24 wherein the adjusting means includes screw means coupled between the riser assembly and the one tether means and operable for varying the effective length of the one tether means between the corresponding limb inner tip and the riser assembly.

28. A bow according to claim 21 wherein each limb is of essentially constant thickness along its elongate extent.

29. A bow according to claim 28 wherein each limb is of varying width along its elongate extent.

30. A bow according to claim 29 wherein the width variation of each limb is defined to cause each limb to experience substantially constant stress along its length during flexing of each limb.

31. A bow according to claim 21 wherein said locations divide the limbs into outer legs between said locations and the outer limb tips and into inner legs between said locations and the inner limb tips.

32. A bow according to claim 31 wherein each limb is of recurved configuration in its outer leg.

33. A bow according to claim 31 wherein each limb in a fully relaxed condition thereof is straight.

34. A bow according to claim 31 wherein the bow is a compound bow, and including eccentric pulley means carried by the outer leg of each limb for coupling the bowstring to the limbs.

35. A bow according to claim 31 wherein the inner and outer legs of each limb are of essentially equal lengths.

36. A bow according to claim 31 wherein the limbs are essentially identical.

37. A bow according to claim 21 wherein said mounting means includes means operable for adjusting the positions of each limb relative to said assembly in a direction along each respective limb hinge axis.

38. A bow according to claim 21 wherein each mounting means comprises an axle cooperating between gudgeon and trunion means carried by the riser assembly and the limb.

39. A bow according to claim 21 wherein each mounting means comprises knife-edge fulcrum means.

* * * * *